US005385342A

United States Patent [19]

Leib

[11] Patent Number: 5,385,342

[45] Date of Patent: Jan. 31, 1995

[54] SHEET FEEDER FOR A SHEET-FED PRINTING PRESS AND METHOD OF FEEDING SHEETS THEREWITH

[75] Inventor: Rudolf Leib, Nussloch, Germany

[73] Assignee: Heidelberger Druckmaschinen Aktiengesellschaft, Heidelberg, Germany

[21] Appl. No.: 49,928

[22] Filed: Apr. 20, 1993

[30] Foreign Application Priority Data

Apr. 21, 1992 [DE] Germany ..... 4213017

[51] Int. Cl.[6] ..... B65H 5/00

[52] U.S. Cl. ..... 271/274; 271/273; 271/275

[58] Field of Search ..... 271/272, 273, 275, 274, 271/200

[56] References Cited

U.S. PATENT DOCUMENTS 4,214,744 7/1980 Evans ..... 271/273 X 4,369,959 1/1983 Hornbuckle ..... 271/274 X 4,607,837 8/1986 Pierce ..... 271/273 X

FOREIGN PATENT DOCUMENTS 1534357 12/1978 United Kingdom .

*Primary Examiner*—H. Grant Skaggs

*Attorney, Agent, or Firm*—Nils H. Ljungman & Associates

[57] ABSTRACT

A sheet feeder, provided at a printing machine, has continuously conveying transport tapes to which transport rollers are engaged. The transport tapes and the transport rollers convey overlappingly fed sheets to a front guide, wherein the last transport rollers, provided upstream of the front guide, are adjustable with respect to the sheet format being processed. There are also additional driving rollers which may be pivoted into contact with the transport tapes in order to process minimum size sheet formats.

15 Claims, 3 Drawing Sheets

SHEET FEEDER FOR A SHEET-FED PRINTING PRESS AND METHOD OF FEEDING SHEETS THEREWITH

BACKGROUND OF THE INVENTION

1. Field of the Invention

This invention generally relates to a sheet feeder for feeding sheets of material, such as paper, to an apparatus which typically handles a number of consecutive sheets of the material at a regular interval of time. Such an apparatus could be, for example any type of printing machine, or printing press. In general, the material stock is provided in the form of a stack of sheets of the material, placed in the vicinity of the sheet feeder, wherein the sheet feeder, adjacent the material stack, can have a tape roller with corresponding timing rollers. For conveying the sheets from the tape rollers to a positioning guide, the sheet feeder can have a number of continuously conveying transport tapes to which transport rollers can be assigned. The transport tapes and the corresponding transport rollers convey overlappingly fed sheets to a front guide, wherein the last transport rollers in the sheet feed direction, provided upstream of the front guide, can be adjustable with respect to the sheet format, or sheet size, of the sheets being processed.

2. Background Information

With modern sheet-fed printing machines, different sheet formats have to be printed, with the sheet formats differing from one another in size by about 50 percent and more. In order to be able to produce a high-quality print at high transport speeds it is of great importance that the sheets taken from the feed stack be precisely conveyed towards the front guides. However, with known printing machines this exact transport cannot always be guaranteed without additional manual input, in particular, when sheet formats having a very small size are being processed.

OBJECT OF THE INVENTION

On the basis of these facts it is the object of the present invention to optimize sheet transport without the need for manual interference, even when processing sheet formats of a very small size, thus significantly decreasing the possibility of mis-alignment of the sheets during transport.

SUMMARY OF THE INVENTION

According to the present invention this object can be achieved by a device in which, when setting the last transport roller to small sheet formats, additional driving rollers, provided upstream of the transport rollers in the sheet-conveying direction, can be pivoted into contact with the transport tapes. As such, the distance between the driving rollers can preferably be kept smaller than the minimum sheet format to be processed. When the last transport rollers are set to accommodate a very small sheet format, the additional driving rollers can preferably bridge any larger distances existing before the transport rollers in the sheet feed direction.

Thus, when small sheet sizes are being fed into the printing press, the small sheets are essentially always pressed against the transport tapes. In other words, the engagement rollers are preferably configurable so that at least one roller, or set of rollers is preferably in contact with each sheet at any position along the transport tapes. This can then provide a continuous transport of small sheets, to be fed by means of the transport tapes, in combination with the additional driving rollers, so that mis-alignment of sheets in the conveying direction, or even transversely thereto, can substantially be avoided. The flexibility in the positioning of the rollers thereby allows both large size sheet formats and small size sheet formats to be processed by a printing press, even when the size difference between the small sheet format and the large sheet format is substantial, or greater than about 50%.

In an advantageous embodiment of the invention the additional driving rollers can be mounted on double levers which can be disposed so as to run parallel to one another. These double levers can be fastened to a traverse spanning the sheet feeder from side to side. Further, a control device can be provided for the double levers to pivot the driving rollers away from the transport tapes by pivoting the double levers. Thus, the control device can make it possible to bring the driving rollers into contact with the transport tapes, if necessary, and the double levers can ensure that the pressure force of the rollers, once set, essentially remains unchanged even in the case of repeated engagements.

A further advantageous embodiment of the invention can be characterized by a device which can have at least two rows of driving rollers disposed so as to preferably run parallel to each other. These two sets of driving rollers can be mounted on brackets which are preferably adjustable along a second traverse extending transversely to the sheet-conveying direction. This second traverse can be fastened, on both sides thereof, to double levers. Further, brackets can be provided along the traverse for mounting the driving rollers thereon, so that the driving rollers can be precisely mounted and adjusted. Furthermore, by mounting the brackets on the second traverse the driving rollers may be laterally adjusted so as to be adaptable to the respective sheet format. In addition, the double levers can ensure that, given repeated-engagement, the adjustment of the driving rollers with respect to the transport tapes essentially remains unchanged.

One aspect of the invention resides broadly in a sheet feeder for feeding sheets of printing stock from a source for providing printing stock to a printing press. The sheet feeder defines a path of travel from the printing stock source to the printing press, and the printing press is configured for printing on printing stock having a range of sizes from a first size to a second size in a direction of travel of the printing stock, with the second size being substantially larger than the first size. The path of travel defines a plurality of consecutive positions along the path of travel from the printing stock source to the printing press, and the sheet feeder comprises: belt apparatus for transporting at least one sheet of the printing stock through each of the plurality of positions along the path of travel from the printing stock source to the printing press, a plurality of roller devices configured for holding the at least one sheet of the printing stock in engagement with the belt apparatus and maintaining alignment of the sheet of printing stock along the path of travel, and a device for positioning the plurality of roller devices to engage at least one of the plurality of roller devices with the at least one sheet of the printing stock at each of the plurality of positions along the path of travel. The device for positioning is configured to engage the at least one of the plurality of roller devices with the at least one sheet of the printing stock at each of the plurality of positions along the path of travel for a sheet of printing stock having a size in the range of sizes from the first size to the second substantially larger size.

Another aspect of the invention resides broadly in a method for feeding sheets of printing stock from a source for providing printing stock to a printing press with a sheet feeder. The sheet feeder defines a path of travel from the printing stock source to the printing press, the printing press being configured for printing on printing stock having a range of sizes from a first size to a second size in a direction of travel of the printing stock, the second size being substantially larger than the first size. The path of travel defines a plurality of consecutive positions along the path of travel from the printing stock source to the printing press. The sheet feeder comprises: belt apparatus for transporting at least one sheet of the printing stock along the path of travel from the printing stock source to the printing press; a plurality of engagement devices configured for holding at least one sheet of the printing stock in engagement with the belt apparatus and maintaining alignment of at least one sheet of printing stock along the path of travel, apparatus for positioning the plurality of engagement means to engage at least one of said plurality of engagement means with at least one sheet of the printing stock at each of the plurality of positions along the path of travel; and the apparatus for positioning the plurality of engagement devices being configured to engage the at least one of the plurality of engagement devices with at least one sheet of the printing stock at each of the plurality of positions along the path of travel for a sheet of printing stock having a size between the first size and the second size. The method comprises the steps of: providing the belt apparatus for transporting at least one sheet of the printing stock through each of the plurality of positions along the path of travel-from the printing stock source to the printing press; providing the plurality of engagement devices configured for holding at least one sheet of the printing stock in engagement with the belt apparatus and maintaining alignment of at least one sheet of printing stock along the path of travel; and providing the apparatus for positioning the plurality of engagement means to engage at least one of the plurality of engagement means with at least one sheet of the printing stock at each of the plurality of positions along the path of travel. The method further comprises: configuring the plurality of engagement devices to engage at least one of the plurality of engagement devices with at least one sheet of the printing stock at each of the plurality of positions along the path of travel for a sheet of printing stock having a size between the first size and the second substantially larger size; transporting at least one sheet from the source to the printing press along the path of travel; and engaging at least one of the plurality of engagement devices with at least one sheet of the printing stock at each of the plurality of positions along the path of travel for a sheet of printing stock having a size in the range from the first size to the second size.

A further aspect of the invention resides broadly in an apparatus for feeding sheets of printing stock from a source for providing printing stock to a printing press. The apparatus defines a path of travel from the source for providing to the printing press, the printing press being configured for printing on printing stock having a range of sizes from a first size to a second size in a direction of travel of the printing stock, the second size being substantially larger than the first size. The path of travel defines a plurality of consecutive positions along the path of travel from the printing stock source to the printing press. The apparatus is configured to perform a method comprising the steps of: configuring a plurality of engagement devices to engage at least one of the plurality of engagement devices with at least one sheet of the printing stock at each of the plurality of positions along the path of travel for a sheet of printing stock having a size between the first size and the second substantially larger size; transporting at least one sheet from the source to the printing press along the path of travel; and engaging at least one of the plurality of engagement devices with at least one sheet of the printing stock at each of the plurality of positions along the path of travel for a sheet of printing stock having a size in the range from the first size to the second size. The apparatus comprises: transporting apparatus for transporting at least one sheet of the printing stock through each of the plurality of positions along the path of travel from the printing stock source to the printing press; a plurality of engagement devices configured for holding at least one sheet of the printing stock in engagement with the transporting apparatus and maintaining alignment of at least one sheet of printing stock along the path of travel; apparatus for positioning the plurality of engagement devices to engage at least one of the plurality of engagement devices with at least one sheet of the printing stock at each of the plurality of positions along the path of travel; and the apparatus for positioning being configured to engage the at least one of the plurality of engagement devices with at least one sheet of the printing stock at each of the plurality of positions along the path of travel for a sheet of printing stock having a size in the range of sizes from the first size to the second substantially larger size.

BRIEF DESCRIPTION OF THE DRAWINGS

A specimen embodiment of the invention is schematically illustrated in the drawings, in which.

DESCRIPTION OF THE PREFERRED EMBODIMENTS

Figure 1:
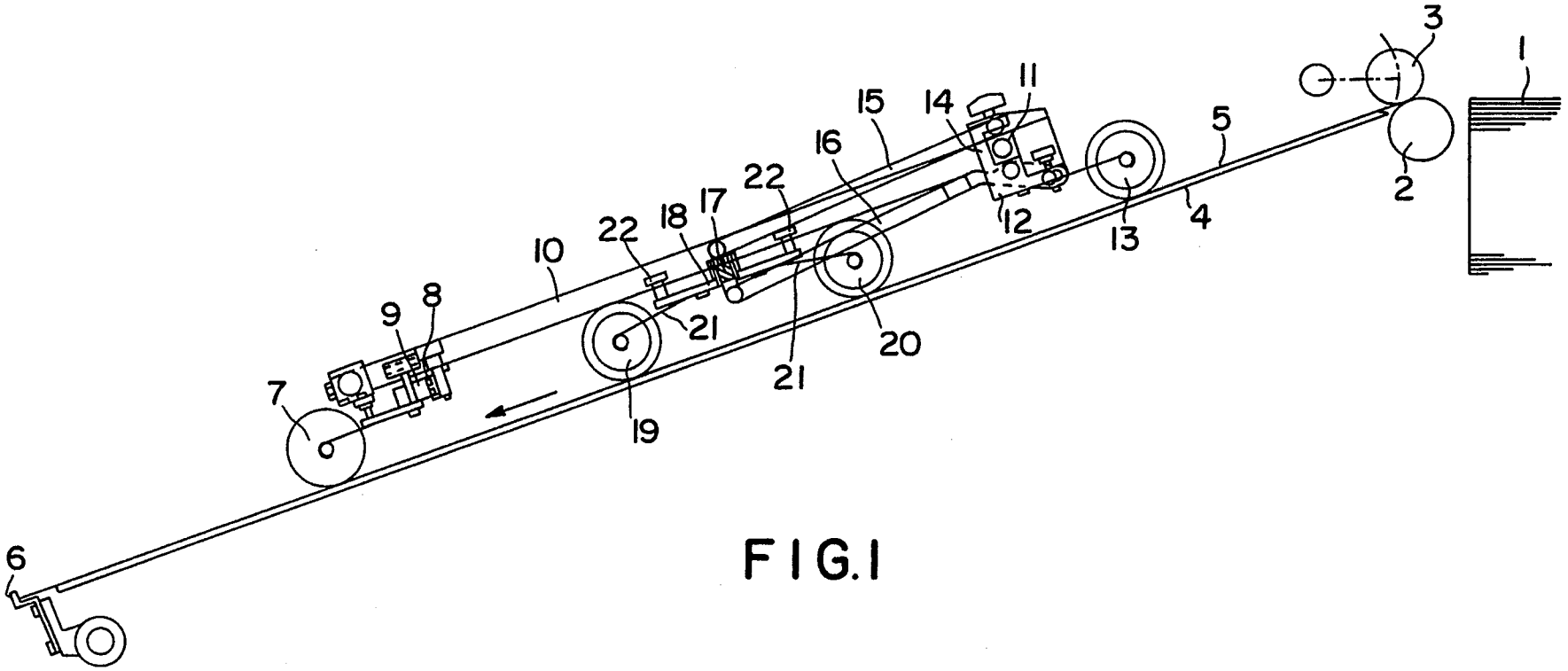
FIG. 1 shows a schematic side elevational view of a sheet feeder set for processing small sheet formats, wherein the driving rollers are in contact with the transport tapes.

With the sheet feeder illustrated in FIG. 1 the sheets of printing stock to be printed on, can preferably be fed, sheet by sheet, from a sheet pile 1 to a tape roller 2 and timing rollers 3. Devices for moving a sheet from a sheet pile into contact with the tape roller 2 are common, and known in the art, and are therefore not described in further detail herein. The individual sheets can then be fed to a feeding table 4 via the tape roller 2 and the corresponding timing rollers 3. By means of transport tapes 5, the individual sheets can be fed to front guides 6 where they are aligned. In a preferred embodiment, the sheets can be fed in an overlapping manner to the front guides 6.

Upstream of the front guides 6, engagement devices, or transport rollers 7, can be provided at a distance which preferably corresponds to the size of the sheet format being processed, which size can differ by as much as 50%, or more, from a smallest possible size to a largest possible size. For example, size differences of up to about 60% to 70% can possibly be processed using the feeder of the present invention. These engagement devices, or transport rollers 7, can be mounted on a crossbar 8 by means of adjustable bearings 9, and can apply a pressure onto the corresponding belts, or transport tapes 5 to thereby hold a sheet of printing stock therebetween during passage of a sheet along a path of travel through the sheet feeder.

Figure 3:
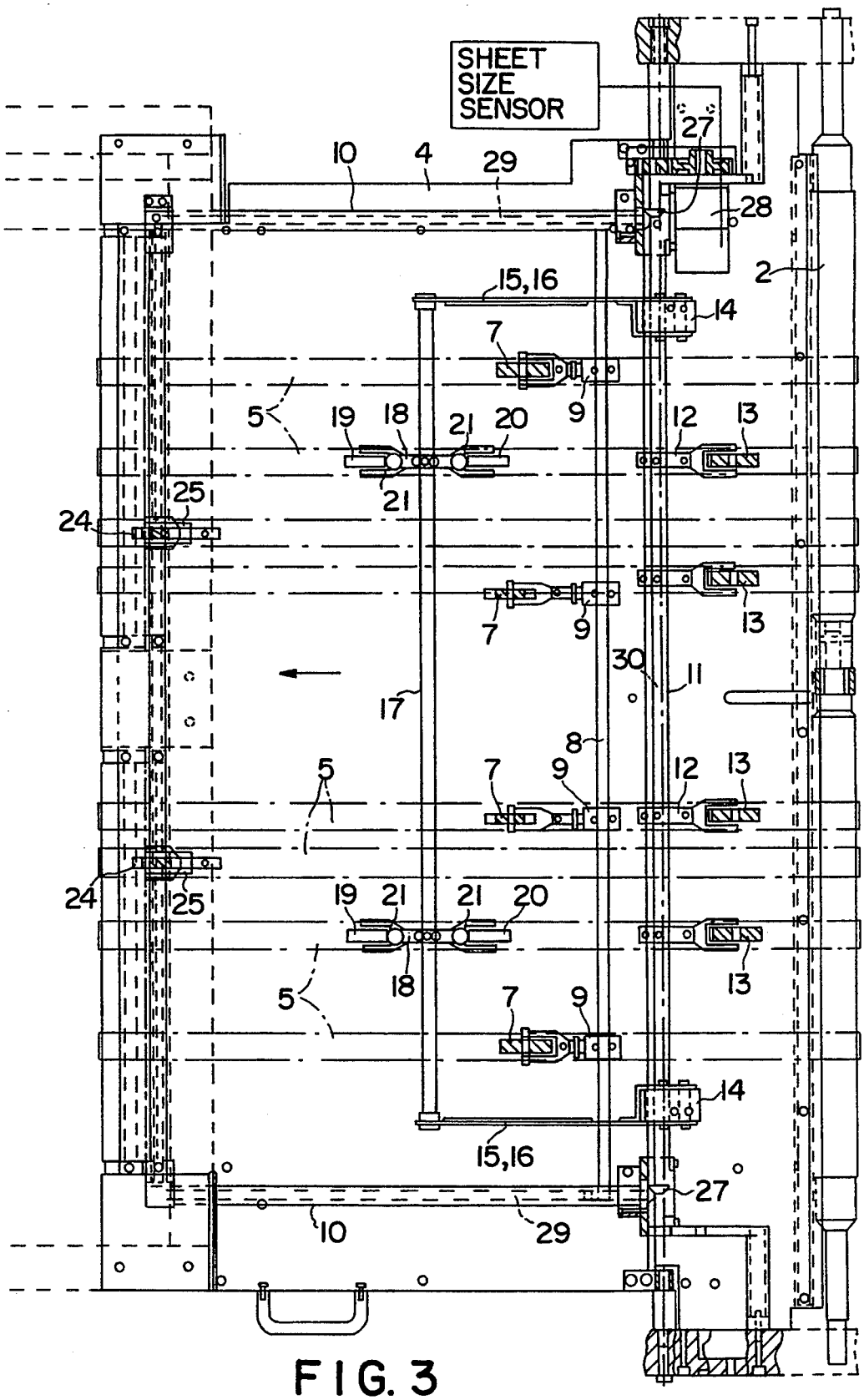
FIG. 3 shows a plan view of the sheet feeder as shown in FIGS. 1 and 2, set for processing large sheet formats.

By means of bearings 9, the transport rollers 7 may be displaced on a traverse, or crossbar 8, in a direction transverse to the sheet-conveying direction. Such a displacement can allow the transport rollers 7 to be brought into a matching position with the underlying transport tapes 5, as shown in FIG. 3. The crossbar 8 can preferably be mounted, at both ends thereof, on rails 10 so as to be displaceable in a direction along the sheet conveying direction, so that the distance between front guide 6 and transport rollers 7 can be adjusted with respect to the sheet format being processed. The position of the transport rollers 7 indicated in FIG. 1 essentially corresponds to approximately the smallest size sheet format that can be processed.

A sheet feeder of the type described by the present invention can also be provided with a traverse 11 extending transversely to the sheet-conveying direction. This traverse 11 can be a square traverse, having a longitudinal passage disposed through a center thereof. On this square traverse 11 there can be provided mountings 12 for holding additional engagement devices, or transport rollers 13. These additional transport rollers 13 can also, by means of the mountings 12, be displaceable transversely to the conveying direction. Such a displacement enables the transport rollers 13 to also be set such that the transport rollers 13 can preferably rest on corresponding ones of the underlying transport tapes 5.

Furthermore, the square traverse 11 can also have mountings 14 mounted thereon. To these mountings 14, at least one double lever 15, 16 can be pivot-mounted to fasten the double levers 15, 16 to the square traverse 11. The double levers can preferably be fastened at both sides of the square traverse 11. An additional traverse 17 can then be mounted to a second end of each of the double levers 15, 16 to extend therebetween. On this additional traverse 17 there can be mounted a number of brackets 18 so as to be displaceable in a longitudinal direction of the traverse 17, or transverse to the sheet-feed direction. The brackets 18 can preferably have spring-like arms 21 for securing additional engagement devices, or driving rollers 19, 20, to both sides of the brackets 18. By means of adjusting screws 22 the engagement pressure of driving rollers 19, 20 with the respective transport tapes 5 can be varied to meet the requirements of the feeder for different types of materials.

While the double levers 15, 16 can essentially move the driving rollers along a straight line path toward and away from the transport tapes 5, it is also conceivable that other types of pivot devices, or lifting means could be configured to perform a similar function.

An alternate embodiment of the present invention could have the pairs of drive rollers 19 and 20 directly mounted to the second end of double levers 15, 16, rather than on a second traverse 17. In such an embodiment, the double levers could be movable in the transverse direction by means of adjustable mountings 14, to align the drive rollers 19 and 20 with corresponding transport tapes 5.

Each of the distances between the driving rollers 3, 7, 13, 19 and 20 is preferably smaller than the minimum size sheet format to be processed so that even the smallest sheet formats may be reliably conveyed against the front guide 6 by means of the transport tapes 5. With such a configuration, there is preferably at least one roller 3, 7, 13, 19 or 20 in contact at any time with each sheet as it is being conveyed along the transport tapes 5.

Figure 2:
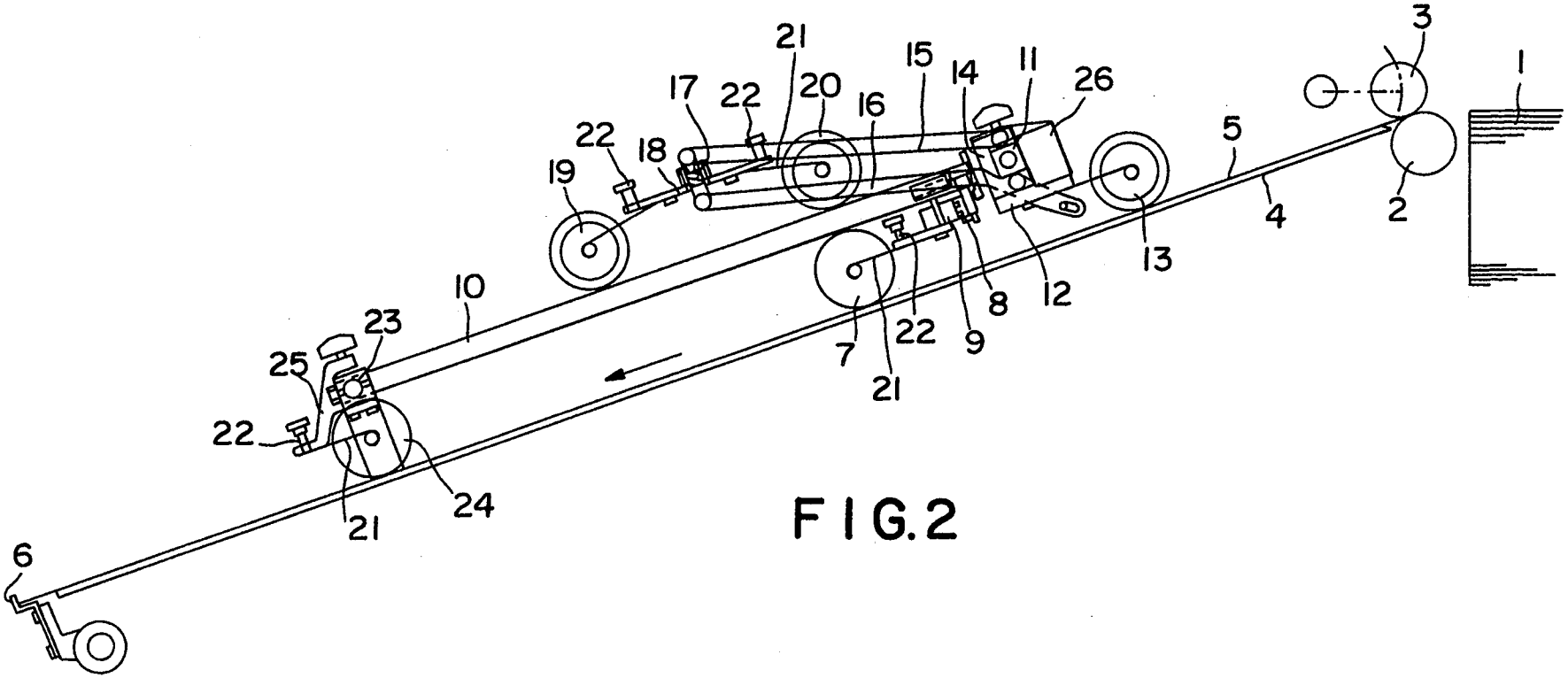
FIG. 2 shows a schematic side elevational view of the sheet feeder shown in FIG. 1 alternately set for processing large sheet formats, wherein the driving rollers can be out of contact with the transport tapes.

The embodiment according to FIG. 2 shows transport rollers 7 set to correspond to what could be a maximum size sheet format to be processed. For this purpose the transport rollers 7 can be displaced into an appropriate position by means of bearings 9 mounted on the rails 10. A traverse 23, connecting the rails 10, can be provided at the lower end of the rails 10. Rollers 24, or brush rollers, may, in turn, be fastened to the traverse 23 by means of holders 25. The rollers 24 can stabilize the sheet transport, in particular during the aligning process at the front guides 6. In so doing, both driving rollers 19, 20 can be disengaged from the transport tapes 5, via the double levers 15, 16, and can then be moved into their idle position above the rail 10. The disengagement of the drive rollers 19, 20 from the transport tapes 5 can preferably be effected automatically, either when the transport rollers 7 are in a certain position, or for a certain sheet format, respectively. One method of effecting such an adjustment would utilize sensor devices (not shown) which sensed the size of the sheet and signalled for the drive rollers 19, 20 and the transport rollers 7 to to be positioned accordingly. Such sensor devices would be common to one in the art, and are therefore not described in detail herein.

As discussed above for rollers 19 and 20, the other rollers, that is roller 7, 13 and 24 can also preferably have pressure adjustment screws 22, for altering a pressure between the rollers and the transport tapes 5. Each of these other rollers 7, 13 and 24 can also preferably be mounted on spring arms 21, which spring arms can preferably be adjusted by means of the pressure adjustment screws 22.

In the plan view as shown in FIG. 3, the transport rollers 7 are shown set to what could be a maximum sheet format, and the driving rollers 19, 20 are shown in a disengaged position. A control device 26 such as, for example, pneumatic cylinders, can be provided at the holders 14 and, for example, can act on one of the double levers 16 to pivot the driving rollers 19, 20 into and out of contact with the transport tapes via the double levers 15, 16. The control means 26 may be programmed such that it automatically adjusts the two positions of the two driving rollers 19, 20, which adjustment may be effected format-dependently.

As shown in FIG. 3, the transport rollers 7 may be adjusted via a servomotor 28, in conjunction with bevel gears and toothed gears 27. The adjustment of the position of the transport rollers 7 may also be automatically effected with the sheet format to be processed.

In other words, the position of the transport rollers 7 can preferably be automatically adjusted as a function of the size of sheet being printed upon. This automatic adjustment can be brought about by means of a sensing device (not shown in detail in the drawings) or a manual input of the size. A sensing device could signal the servomotor 28 to start, thereby rotating the shaft 30 preferably disposed within the square traverse 11. The bevel gears at the ends of the traverse 11 can then rotate a threaded spindle 29, disposed substantially perpendicular to the traverse 11. The crossbar 8 can have, at each end thereof, an engagement device for engaging in the threads of the threaded spindle 29, to thereby cause the crossbar 8 to move along the path of travel.

One feature of the invention resides broadly in a sheet feeder, provided at a printing machine, comprising a sheet pile followed by a tape roller having timing rollers, and comprising continuously conveying transport tapes to which transport rollers are assigned, the transport tapes and the transport rollers conveying overlappingly fed sheets to a front guide, the last transport rollers, provided upstream of the front guide, being adjustable with respect to the sheet format to be processed, characterized in that, when setting the last transport rollers 7 to small sheet formats, additional driving rollers 19, 20 are provided upstream of the transport rollers 7, seen in sheet-conveying direction, and may be pivoted into contact with the transport tapes 5, the distance between the driving rollers being smaller than the minimum sheet format to be processed.

Another feature of the invention resides broadly in the sheet feeder, characterized in that the additional driving rollers 19, 20 are mounted on double levers 15, 16 running parallel to each other, the double levers being fastened to a traverse 11, and in that control means 26 are assigned to the double levers 15, 16 for pivoting the driving rollers 19, 20.

Yet another feature of the invention resides broadly in the sheet feeder, characterized in that at least two parallel rows of driving rollers 19, 20 are mounted on brackets 18, the brackets being adjustable on a second traverse 17 extending transversely to the sheet-conveying direction, and in that the second traverse 17 is fastened, on both sides thereof, to the double levers 15, 16.

Further examples of sheet feeders and devices for conveying sheets can be found in the following U.S. Patents: U.S. Pat. No. 3,975,013 to Horst Deisting, entitled "Sheet Feeding Device"; U.S. Pat. No. 4,184,673 to Gunter Weisbach, entitled "Method of and Apparatus for Aligning Sheets Advancing in an Overlapping Array to a Printing Machine"; U.S. Pat. No. 4,825,762 to Hermann Fischer, entitled "Sheet Transport Arrangement for Printing Machines"; and U.S. Pat. No. 5,133,616 to Oyaide and Kawahira, entitled "Printing Machine".

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A sheet feeder for feeding sheets of printing stock from a source for providing printing stock to a printing press, said sheet feeder defining a path of travel from the printing stock source to the printing press, the printing press being configured for printing on sheets of printing stock having a range of sizes from a first size to a second size in a direction of travel of the printing stock, the second size being substantially larger than the first size, the path of travel defining a plurality of consecutive positions along the path of travel from the printing stock source to the printing press, said sheet feeder comprising:

belt means for transporting at least one sheet of the printing stock through each of said plurality of positions along the path of travel from the printing stock source to the printing press;

a plurality of roller means configured for holding at least one sheet of the printing stock in engagement with said belt means and maintaining alignment of the at least one sheet of printing stock along said path of travel;

means for positioning said plurality of roller means to engage at least one of said plurality of roller means with at least one sheet of the printing stock at each of said plurality of positions along said path of travel;

said means for positioning being configured to engage said at least one of said plurality of roller means with the at least one sheet of the printing stock at each of said plurality of positions along said path of travel for a sheet of printing stock having a size in said range of sizes from the first size to the second substantially larger size;

the path of travel defines a first direction along the path of travel;

said means for positioning said plurality of roller means comprises means for spacing said plurality of roller means a distance from one another along said first direction of the path of travel;

the distance between ones of said plurality of spaced apart roller means along said first direction of the path of travel being less than said size of at least one sheet of printing stock being fed by said sheet feeder;

said sheet feeder has a first end disposed adjacent the source for providing printing stock and a second end disposed towards the printing press;

at least a first of said roller means being disposed adjacent the second end of said sheet feeder;

said at least a first of said roller means being spaced a second distance from the second end of said sheet feeder and a third distance from the first end of said sheet feeder;

said at least a first of said roller means being adjustable along said path of travel to adjust the second distance to be substantially the same as the size of a sheet of printing stock being fed by said sheet feeder;

said means for positioning said plurality of roller means to engage at least one of said plurality of roller means with the at least one sheet of the printing stock further comprise means for pivoting at least a second of said roller means into and out of contact with said belt means as a function of the size of the at least one sheet;

said means for pivoting being configured to pivot said at least a second of said roller means into engagement with said belt means and between said at least a first of said roller means and the first end of said sheet feeder when said third distance is greater than the size of at least one sheet;

said means for pivoting being configured to pivot said at least a second of said roller means out of engagement with said belt means when said third distance is less than the size of a sheet of printing stock being fed by said sheet feeder;

said sheet feeder further comprises a first traverse disposed across the path of travel;

said means for pivoting being disposed on said first traverse;

said means for pivoting comprising:

control means for controlling pivoting of said means for pivoting as a function of the size of a sheet of printing stock; and at least one double lever, said at least one double lever comprising two levers spaced apart from one another and parallel to one another;

each of said at least two levers having a first end attached to said first traverse, and a second end attached to said at least a second of said roller means; and said at least two levers being configured for movement of said at least a second of said roller means in a straight line path towards and away from said belt means;

said at least one double lever comprises two double levers disposed on said first traverse;

said means for pivoting further comprises a second traverse connected to and disposed between the second ends of the at least two levers of each double lever, said second traverse being disposed across said path of travel;

said second traverse comprising bracket means for mounting said at least a second of said roller means to said second traverse; and said at least a second of said roller means comprises at least two of said second roller means spaced apart along said second traverse.

2. The sheet feeder according to claim 1, wherein:

said bracket means for mounting said at least a second of said roller means to said second traverse comprise spring arms;

said spring arms having a first end for being mounted to said second traverse and a second end for being mounted to said at least a second of said roller means;

said bracket means further comprise adjusting screws for varying engagement pressure between said at least a second of said roller means and the belt means;

said belt means comprise a plurality of spaced apart belt strips, said belt strips being spaced apart from one another in a direction transverse to said path of travel;

said at least a second of said roller means comprises at least two pairs of said second roller means spaced apart along said second traverse, each roller means of each pair of said at least two pairs of said second roller means being disposed in alignment along said path of travel;

said at least two pairs of said second roller means being movable along said second traverse in said direction transverse to said path of travel to align each roller means of said at least two pair of said second roller means with one of said plurality of belt strips;

said sheet feeder further comprises a pair of engaged timing rollers disposed at said first end of said sheet feeder adjacent the printing stock source;

at least a third of said roller means being disposed spaced apart from said first end of said sheet feeder between said at least a first of said roller means and said first end of said sheet feeder;

said at least a third of said roller means being mounted on said first traverse;

said sheet feeder comprises a third traverse disposed across said path of travel;

said at least a first of said roller means being disposed on said third traverse;

said sheet feeder has a first lateral side portion disposed along a first side of the path of travel, and a second lateral side portion disposed along a second side of the path of travel;

said sheet feeder further comprises:

bar means extending from said first traverse towards said second end of said sheet feeder along each of said first lateral side portion and said second lateral side portion of said sheet feeder, each of said bar means having a first end attached to said first traverse and a second end adjacent said second end of said sheet feeder; and a fourth traverse connected to and disposed between said second end of each of said first and said second bar means;

said fourth traverse comprising at least a fourth of said roller means disposed thereon;

said sheet feeder further comprises means for adjusting a position of said at least a first of said roller means along said path of travel;

said means for adjusting said at least a first of said roller means comprising:

rod means disposed longitudinally within said first traverse, said rod means having a first end and a second end, said first end being disposed adjacent said first side of said sheet feeder and said second end being disposed adjacent said second side of said sheet feeder;

a screw gear disposed at each of said first side portion and said second side portion of said sheet feeder, said screw gears being disposed parallel to said path of travel;

said third traverse having a first end and a second end, said first end comprising means for engaging said screw gear of said first side of said sheet feeder and said second end comprising means for engaging said screw gear of said second side of said sheet feeder;

each of said screw gears having a first end disposed adjacent said rod means and perpendicularly to said rod means;

said first end of each of said screw gears comprising a bevel gear;

said first and second ends of said rod means comprising a bevel gear for engaging said bevel gear of each said screw gear;

motor means for rotating said rod means to rotate said screw gears via said engaged bevel gears and thereby move said third traverse with said at least a first of said roller means disposed thereon;

said control means of said means for pivoting further comprises pneumatic cylinders, said pneumatic cylinders being connected to at least one of said two levers of each double lever to pivot said double lever;

said at least a first of said roller means comprise four transport rollers spaced apart from one another along said third traverse, said four transport rollers being adjustable along said third traverse to position each of said four transport rollers in alignment with one of said belt strips;

said at least a third of said roller means comprise four transport rollers spaced apart from one another along said first traverse, said four transport rollers being adjustable along said first traverse to position each of said four transport rollers in alignment with one of said belt strips;

said at least a fourth of said roller means comprise two transport rollers spaced apart from one another along said fourth traverse, said two transport rollers being adjustable along said fourth traverse to position each of said two transport rollers in alignment with one of said belt strips;

said at least a second of said roller means comprise two pairs of driving rollers;

each transport roller of said at least a first of said roller means, said at least a third of said roller means and said at least a fourth of said roller means comprising means for adjusting a pressure of said transport roller against said one of said belt strips;

each of said first traverse, said third traverse and said fourth traverse comprising slidably adjustable mounting means for mounting said transport rollers thereon;

said slidably adjustable mounting means comprising spring arms, said spring arms having a first end connected to a corresponding traverse, and a second end connected to said transport rollers;

said sheet feeder further comprises a feeder table, said feeder table having a first surface disposed towards said plurality of roller means;

said belt strips being disposed along said first surface of said feeder table;

said at least one sheet of printing stock comprises a plurality of overlapping sheets of printing stock; and said first size differing from said second size by up to about 50%.

3. A method for feeding sheets of printing stock from a source for providing printing stock to a printing press with a sheet feeder, said sheet feeder defining a path of travel from the printing stock source to the printing press, the printing press being configured for printing on printing stock having a range of sizes from a first size to a second size in a direction of travel of the printing stock, the second size being substantially larger than the first size, the path of travel defining a plurality of consecutive positions along the path of travel from the printing stock source to the printing press, said sheet feeder comprising: a first end disposed adjacent the printing stock source; a second end disposed towards the printing press; belt means for transporting at least one sheet of the printing stock along the path of travel from the printing stock source to the printing press; a plurality of engagement means configured for holding at least one sheet of the printing stock in engagement with said belt means and maintaining alignment of at least one sheet of printing stock along said path of travel; means for positioning said plurality of engagement means to engage at least one of said plurality of engagement means with at least one sheet of the printing stock at each of said plurality of positions along said path of travel; said plurality of engagement means comprising at least a first engagement means disposed towards the second end of said sheet feeder, said at least a first engagement means for engaging a sheet of printing stock at least adjacent the second end of said sheet feeder, and said at least a first engagement means being spaced a variable first distance from the second end and defining a second distance to the first end; said means for positioning comprising means for adjusting a position of said at least a first engagement means with respect to the second end to vary the first distance to correspond to the size of a sheet of printing stock being transported; said plurality of engagement means further comprising at least a second engagement means for being engaged with at least one sheet of printing stock, at a position between said engaged first engagement means and the first end of said sheet feeder means when the second distance is greater than a size of a sheet of printing stock; and said means for positioning said plurality of engagement means comprising means for pivoting said at least a second engagement means into and out of engagement with at least one sheet of the printing stock, said means for pivoting comprising: means for pivoting said at least a second roller into engagement when the second distance is less than a size of a sheet of printing stock; and means for pivoting said at least a second roller out of engagement when the second distance is less than a size of a sheet of printing stock, said method comprising the steps of:

providing said belt means for transporting at least one sheet of the printing stock through each of said plurality of positions along the path of travel from the printing stock source to the printing press;

providing said plurality of engagement means configured for holding at least one sheet of the printing stock in engagement with said belt means and maintaining alignment of at least one sheet of printing stock along said path of travel;

providing said means for positioning said plurality of engagement means to engage at least one of said plurality of engagement means with at least one sheet of the printing stock at each of said plurality of positions along said path of travel;

said method further comprising:

adjusting a position of said at least a first of said engagement means along said path of travel to adjust the first distance to be substantially the same as the size of a sheet being fed;

configuring said plurality of engagement means to engage at least one of said plurality of engagement means with at least one sheet of the printing stock at each of said plurality of positions along the path of travel for a sheet of printing stock having a size between said first size and said second substantially larger size;

transporting at least one sheet from the source to the printing press along the path of travel; and said configuring of said plurality of engagement means comprising engaging said at least a first engagement means with at least one sheet of the printing stock at least adjacent the second end of said sheet feeder, pivoting said at least one second engagement means into engagement with the at least one sheet of printing stock between said at least a first engagement means and the first end when the size of the at least one sheet is less than the second distance, and pivoting said at least one second engagement means out of engagement when the size of the at least one sheet is the same as or greater than the second distance.

4. The method according to claim 3, wherein the path of travel defines a first direction along the path of travel and said method further comprises the step of:

spacing said plurality of engagement means a distance from one another along said first direction of the path of travel to configure the distance between ones of said plurality of spaced apart engagement means along said first direction of the path of travel to be less than the size of a sheet of printing stock being fed by said sheet feeder.

5. The method according to claim 4, wherein said sheet feeder further comprises a first traverse disposed across the path of travel, said means for pivoting being disposed on said first traverse, said means for pivoting comprising: control means for controlling pivoting of said means for pivoting as a function of the size of sheet being processed; and at least one double lever, said at least one double lever comprising two levers spaced apart from one another and parallel to one another, each of said at least two levers having a first end attached to said first traverse, and a second end attached to said at least a second engagement means, and said method further comprises:

determining a size of a sheet of print stock being fed;

controlling pivoting of said means for pivoting as a function of the size; and pivoting said at least a second engagement means towards and away from said belt means in a straight line path by pivoting said at least two levers of said at least one double lever.

6. The method according to claim 5, wherein said at least one double lever comprises two double levers disposed on said first traverse, said means for pivoting further comprises a second traverse connected to and disposed between the second ends of the at least two levers of each double lever, said second traverse being disposed across said path of travel, said second traverse comprising bracket means for mounting said at least a second engagement means to said second traverse, said at least a second engagement means comprises at least two of said at least a second engagement means spaced apart along said second traverse, and said method further comprises:

simultaneously pivoting each of said two double levers towards and away from said belt means as a function of the size of a sheet being fed to move said second traverse towards and away from said belt means to simultaneously move each of said at least two of said second engagement means towards and away from said belt means.

7. The method according to claim 6, wherein:

said bracket means for mounting said at least a second engagement means to said second traverse comprise:

spring arms, said spring arms having a first end for being mounted to said second traverse and a second end for being mounted to said at least a second engagement means, and adjusting screws for varying-engagement pressure between said at least a second engagement means and said belt means, and said method further comprises adjusting said engagement pressure between said at least a second engagement means and said belt means;

said belt means comprise a plurality of spaced apart belt strips, said belt strips being spaced apart from one another in a direction transverse to said path of travel, said at least two of said second engagement means comprises at least two pairs of said second engagement means spaced apart along said second traverse, each engagement means of each pair of said at least two pairs of said second engagement means being disposed in alignment along said path of travel, and said method further comprises moving each of said pairs of second engagement means along said second traverse in said direction transverse to said path of travel to align each of said at least two pair of second engagement means with one of said plurality of belt strips;

said sheet feeder further comprises:

a pair of engaged timing rollers disposed at said first end of said sheet feeder adjacent the printing stock source;

at least a third of said engagement means being disposed spaced apart from said first end of said sheet feeder between said at least a first engagement means and said first end of said sheet feeder;

said at least a third engagement means being mounted on said first traverse;

said sheet feeder comprises a third traverse disposed across said path of travel;

said at least a first engagement means being disposed on said third traverse;

said sheet feeder has a first lateral side portion disposed along a first side of the path of travel, and a second lateral side portion disposed along a second side of the path of travel;

bar means extending from said first traverse towards said second end of said sheet feeder along each of said first side lateral side portion and said second lateral side portion of said sheet feeder, each of said bar means having a first end attached to said first traverse and a second end adjacent said second end of said sheet feeder;

a fourth traverse connected to and disposed between said second end of each of said first and said second bar means; and said fourth traverse comprising at least a fourth of said engagement means disposed thereon;

said plurality of engagement means comprise a plurality of rollers;

and said method further comprises one of:

set A) of limitations when said second distance is greater than the size of a sheet being fed; and set B) of limitations when said second distance is less than the size of a sheet being fed;

wherein said set A) of limitations comprises:

feeding at least one sheet of printing stock between said engaged timing rollers to said belt means;

passing the at least one sheet of printing stock into simultaneous engagement with said timing rollers and said third engagement means;

passing the at least one sheet of printing stock out of engagement with said timing rollers;

passing the at least one sheet of printing stock into simultaneous engagement with said third engagement means and a first engagement means of each pair of said second engagement means;

passing the at least one sheet of printing stock out of engagement with said third engagement means;

passing the at least one sheet of printing stock into simultaneous engagement with said first engagement means of each pair of said second engagement means and a second engagement means of each pair of said second engagement means;

passing the at least one sheet of printing stock out of engagement with said first engagement means of each pair of said second engagement means;

passing the at least one sheet of printing stock into simultaneous engagement with said first engagement means and said second engagement means of each pair of said second engagement means;

passing the at least one sheet of printing stock out of engagement with said second engagement means of each pair of said second engagement means;

passing the at least one sheet of printing stock into simultaneous engagement with said first engagement means and said fourth engagement means;

passing the at least one sheet of printing stock out of engagement with said first engagement means; and passing the at least one sheet of printing stock out of engagement with said fourth engagement means to said printing press;

and set B) of limitations comprises:

feeding at least one sheet of printing stock between said engaged timing rollers to said belt means;

passing the at least one sheet of printing stock into simultaneous engagement with said timing rollers and said third engagement means;

passing the at least one sheet of printing stock out of engagement with said timing rollers;

passing the at least one sheet of printing stock into simultaneous engagement with said third engagement means and said first engagement means;

passing the at least one sheet of printing stock out of engagement with said third engagement means;

passing the at least one sheet of printing stock into simultaneous engagement with said first engagement means and said fourth engagement means;

passing the at least one sheet of printing stock out of engagement with said first engagement means; and passing the at least one sheet of printing stock out of engagement with said fourth engagement means to said printing press.

8. The method according to claim 3, wherein: said sheet feeder comprises a first traverse disposed across the path of travel; said means for pivoting comprises: at least first and second lever means disposed on said first traverse and spaced apart from one another along said first traverse, each of said lever means comprising at least two levers spaced apart from one another and parallel to one another, each of said at least two levers of each lever means having a first end attached adjacent said first traverse, and a second end opposite to said first end; a second traverse connected to the second ends of the at least two levers of said at least first and second lever means, said second traverse being disposed across said path of travel; and said second traverse comprising means for mounting said at least a second engagement means to said second traverse; and said method further comprises the steps of:

simultaneously pivoting each of said at least two levers of each said lever means towards and away from said belt means as a function of the size of a sheet being fed to move said second traverse towards and away from said belt means to move said at least a said second engagement means towards and away from said belt means to respectively engage and disengage said at least a second engagement means with the at least one sheet of printing stock being fed.

9. Apparatus for feeding sheets of printing stock from a source for providing printing stock to a printing press, said apparatus defining a path of travel from said source for providing to said printing press, the printing press being configured for printing on printing stock having a range of sizes from a first size to a second size in a direction of travel of the printing stock, the second size being substantially larger than the first size in a direction of travel of the printing stock, the path of travel defining a plurality of consecutive positions along the path of travel from the printing stock source to the printing press, said apparatus being configured to perform a method comprising the steps of: configuring a plurality of engagement means to engage at least one of the plurality of engagement means with at least one sheet of the printing stock at each of said plurality of positions along the path of travel for a sheet of printing stock having a size between said first size and said second substantially larger size; transporting the at least one sheet from the source to the printing press along the path of travel; and engaging at least one of said plurality of engagement means with at least one sheet of the printing stock at each of said plurality of positions along said path of travel for a sheet of printing stock having a size in said range from said first size to said second size; said apparatus comprising:

a first end disposed adjacent the printing stock source;

a second end disposed towards the printing press;

transporting means for transporting at least one sheet of the printing stock through each of said plurality of positions along the path of travel from the printing stock source to the printing press;

a plurality of engagement means configured for holding at least one sheet of the printing stock in engagement with said transporting means and maintaining alignment of the at least one sheet of printing stock along said path of travel;

means for positioning said plurality of engagement means to engage at least one of said plurality of engagement means with at least one sheet of the printing stock at each of said plurality of positions along said path of travel;

said plurality of engagement means comprising at least a first engagement means disposed towards the second end of said sheet feeder, said at least a first engagement means for engaging a sheet of printing stock at least adjacent the second end of said sheet feeder, and said at least a first engagement means being spaced a variable first distance from the second end and defining a second distance to the first end;

said means for positioning comprising means for adjusting a position of said at least a first engagement means with respect to the second end to vary the first distance to corresponds to the size of a sheet of printing stock being transported;

said plurality of engagement means further comprising at least a second engagement means for being engaged with at least one sheet of printing stock, at a position between said engaged first engagement means and the first end Of said sheet feeder means when the second distance is greater than a size of a sheet of printing stock; and said means for positioning comprising means for engaging and disengaging said at least a second engagement means with at least one sheet of the printing stock, said means for engaging and disengaging comprising:

means for engaging said at least a second engagement means when the second distance is less than a size of a sheet of printing stock; and means for disengaging said at least a second engagement means when the second distance is less than a size of a sheet of printing stock.

10. The apparatus according to claim 9, wherein:

said means for engaging and disengaging comprises means for pivoting at least a second of said engagement means into and out of contact with said transporting means as a function of the size of the at least one sheet of printing stock being fed;

said means for pivoting being configured to pivot said at least a second of said engagement means into engagement with said belt means and between said at least a first of said engagement means and the first end of said feeding apparatus when said second distance is greater than the size of the at least one sheet of printing stock being processed; and said means for pivoting being configured to pivot said at least a second of said engagement means out of engagement with said transporting means when said second distance is less than the size of at least one sheet of printing stock being processed.

11. The apparatus according to claim 10, wherein:

the path of travel defines a first direction along the path of travel;

said means for positioning said plurality of engagement means comprises means for spacing said plurality of engagment means a distance from one another along said first direction of the path of travel;

the distance between ones of said plurality of spaced apart engagement means along said first direction of the path of travel being less than the size of at least one sheet of printing stock being fed;

the first size of at least one sheet of printing stock being fed is about 50% less than the second size;

said engagement means comprise rollers; and said transporting means comprise belt means.

12. The apparatus according to claim 11, wherein:

said feeding apparatus further comprises a first traverse disposed across the path of travel;

said means for pivoting being disposed on said first traverse;

said means for pivoting comprising:

control means for controlling pivoting of said means for pivoting as a function of the size of the sheet of printing stock; and at least one double lever, said at least one double lever comprising two levers spaced apart from one another and parallel to one another;

each of said at least two levers having a first end attached to said first traverse, and a second end attached to said at least a second of said roller means; and said at least two levers being configured for movement of said at least a second of said roller means in a straight line path towards and away from said belt means.

13. The apparatus according to claim 12, wherein:

said at least one double lever comprises two double levers disposed on said first traverse;

said means for pivoting further comprises a second traverse connected to and disposed between the second ends of the at least two levers of each double lever, said second traverse being disposed across said path of travel;

said second traverse comprising bracket means for mounting said at least a second of said roller means to said second traverse; and said at least a second of said roller means comprises at least two of said roller means spaced apart along said second traverse.

14. The apparatus according to claim 13, wherein:

said bracket means for mounting said at least a second of said roller means to said second traverse comprise spring arms;

said spring arms having a first end for being mounted to said second traverse and a second end for being mounted to said at least a second of said roller means;

said bracket means further comprise adjusting screws for varying engagement pressure between said at least a second of said roller means and the belt means;

said belt means comprise a plurality of spaced apart belt strips, said belt strips being spaced apart from one another in a direction transverse to said path of travel;

said at least a second of said roller means comprises at least two pairs of said roller means spaced apart along said second traverse, each roller means of each pair of said at least two pairs of said second roller means being disposed in alignment along said path of travel;

said at least two pairs of said second roller means being movable along said second traverse in said direction transverse to said path of travel to align each of said at least two pairs of said second roller means with one of said plurality of belt strips;

said feeding apparatus further comprises a pair of engaged timing roller disposed at said first end of said feeding apparatus adjacent the printing stock source;

at least a third of said plurality of roller means being disposed spaced apart from said first end of said feeding apparauts between said at least a first roller means and said first end of said feeding apparatus;

said at least a third of said plurality of roller means being mounted on said first traverse;

said feeding apparatus comprises a third traverse disposed across said path of travel;

said at least a first roller means being disposed on said third traverse;

said feeding apparatus has a first lateral side portion disposed along a first side of the path of travel, and a second lateral side portion disposed along a second side of the path of travel;

said feeding apparatus further comprises:

bar means extending from said first traverse towards said second end of said feeding apparatus along each of said first side lateral side portion and said second lateral side portion of said feeding apparatus, each of said bar means having a first end attached to said first traverse and a second end adjacent said second end of said feeding apparatus; and a fourth traverse connected to and disposed between said second end of each of said first and said second bar means;

said fourth traverse comprising at least a fourth of said roller means disposed thereon;

said feeding apparatus further comprises means for adjusting a position of said at least a first roller means along said path of travel;

said means for adjusting said at least a first roller means comprising:

rod means disposed longitudinally within said first traverse, said rod means having a first end and a second end, said first end being disposed adjacent said first side of said feeding apparatus and said second end being disposed adjacent said second side of said feeding apparatus;

a screw gear disposed at each of said first side portion and said second side portion of said feeding apparatus, said screw gears being disposed parallel to said path of travel;

said third traverse having a first end and a second end, said first end comprising means for engaging said screw gear of said first side of said feeding apparatus and said second end comprising means for engaging said screw gear of said second side of said feeding apparatus;

each of said screw gears having a first end disposed adjacent said rod means and perpendicularly to said rod means;

said first end of each of said screw gears comprising a bevel gear;

said first and second ends of said rod means comprising a bevel gear for engaging said bevel gear of each said screw gear;

motor means for rotating said rod means to rotate said screw gears via said engaged bevel gears and thereby move said third traverse with said at least a first roller means disposed thereon;

said control means of said means for pivoting further comprises pneumatic cylinders, said pneumatic cylinders being connected to at least one of said two levers of each double lever to pivot said double lever;

said at least a first roller means comprise four transport rollers spaced apart from one another along said third traverse, said four transport rollers being adjustable along said third traverse to position each of said four transport rollers in alignment with one of said belt strips;

said at least a third roller means comprise four transport rollers spaced apart from one another along said first traverse, said four transport rollers being adjustable along said first traverse to position each of said four transport rollers in alignment with one of said belt strips;

said at least a fourth roller means comprise two transport rollers spaced apart from one another along said fourth traverse, said two transport rollers being adjustable along said fourth traverse to position each of said two transport rollers in alignment with one of said belt strips;

said at least a second roller means comprise two pairs of driving rollers;

each transport roller of said at least a first roller means, said at least a third roller means and said at least a fourth roller means comprising means for adjusting a pressure of said transport roller against said belt strip;

each of said first traverse, said third traverse and said fourth traverse comprising slidably adjustable mounting means for mounting said transport rollers thereon; and said slidably adjustable mounting means comprising spring arms, said spring arms having a first end connected to a corresponding traverse, and a second end connected to said transport rollers.

15. The sheet feeder according to claim 9, wherein:

said sheet feeder comprises a first traverse disposed across the path of travel;

said means for engaging and disengaging comprises means for pivoting said at least a second engagement means into and out of engagement with the at least one sheet;

said means for pivoting comprise:

at least first and second lever means disposed on said first traverse and spaced apart from one another along said first traverse, each of said lever means comprising at least two levers spaced apart from one another and parallel to one another, each of said at least two levers of each lever means having a first end attached adjacent said first traverse, and a second end opposite to said first end;

a second traverse connected to the second ends of the at least two levers of said at least first and second lever means, said second traverse being disposed across said path of travel; and said second traverse comprising means for mounting said at least a second engagement means to said second traverse.

* * * * *